US005235770A

United States Patent [19]

Simon et al.

[11] Patent Number: 5,235,770

[45] Date of Patent: Aug. 17, 1993

[54] STRIKER DEVICE FOR A FIREARM

[75] Inventors: Georges Simon, Saint-Germain-Du-Puy; Marc Rochelle, Bourges, both of France

[73] Assignee: Giat Industries, Versailles, France

[21] Appl. No.: 897,785

[22] Filed: Jun. 12, 1992

[30] Foreign Application Priority Data

Jun. 18, 1991 [FR] France ..... 91 07452

[51] Int. Cl.[5] ..... F41A 19/13

[52] U.S. Cl. ..... 42/69.01; 89/22

[58] Field of Search ..... 89/24, 17, 19, 22, 25; 42/69.01, 69.02, 16, 41, 42.01

[56] References Cited

U.S. PATENT DOCUMENTS

| | | | |
|---|---|---|---|
| 282,548 | 8/1883 | McLean et al. | 89/24 |
| 2,474,743 | 6/1949 | Kurti | 42/16 |
| 2,805,604 | 9/1957 | Humphrey | 42/69.01 |
| 2,811,902 | 11/1957 | Dixon | 42/16 |
| 2,950,653 | 8/1960 | Harvey | 42/16 |
| 3,547,001 | 12/1970 | Stoner | 89/17 |

FOREIGN PATENT DOCUMENTS

| | | | |
|---|---|---|---|
| 90497 | 12/1922 | Austria | 42/69.02 |
| 736564 | 6/1943 | Fed. Rep. of Germany | 89/24 |
| 666119 | 6/1988 | Switzerland . | |

*Primary Examiner*—Stephen M. Johnson

*Attorney, Agent, or Firm*—Bell, Seltzer, Park & Gibson

[57] ABSTRACT

A striker device for striking a firearm cartridge, the cartridge comprising a case provided with a cap and the firearm including a bolt having a front face that is normally intended to be pressed against the cartridge case, a striking pin guided to move in translation in the bolt and including a tip for striking the cap of the cartridge, means for displacing the striking pin between a cocked position in which the striking pin is retracted into the bolt and a firing position in which the tip of the striking pin projects from the front face of the bolt to strike the cap of the cartridge, means for taking up clearance between the front face of the bolt and the cartridge, said means comprising a part having the striking pin passing axially therethrough and itself displaceable in translation relative to the bolt to occupy a firing position in which its front end projects from the front face of the bolt and bears against the cartridge case, the extent to which the tip of the firing pin projects relative to the front end of the moving part in the firing position being defined in a manner that does not vary by the striking pin coming into abutment against the moving part, and abutment means being provided on the striking pin and on the moving part to displace the moving part into a retracted position inside the bolt when the striking pin is returned to its cocked position.

5 Claims, 2 Drawing Sheets

PRIOR ART

STRIKER DEVICE FOR A FIREARM

The invention relates to a striker device for a firearm of the type comprising a chamber for receiving a round of ammunition whose cartridge case is provided with a percussion cap.

BACKGROUND OF THE INVENTION

The striker devices fitted to small or medium caliber guns generally comprise a striking pin which is guided to move in translation in a bolt that includes a front face against which the case of a cartridge to be fired is normally pressed.

The striking pin, or the striker assembly constituted by the striking pin per se and a striker mass, is associated with means for displacing it between a cocked position where the striking pin is retracted into the bolt and a firing position where the tip of the pin projects through the front face of the bolt to strike the cap in the cartridge.

For any given type of ammunition, the extent to which the tip of the pin projects is determined accurately by a minimum value for ensuring that the cap is always fired, and by a maximum value for ensuring that there is no danger of the cap being perforated by the striking pin (which would give rise to dangerous gas leakage).

The stroke of the striking pin is limited by abutment against the bolt mechanism such that the extent to which the tip of the pin projects from the front face of the bolt is constant.

However, it can happen that there is a relatively large longitudinal gap in the firing chamber between the front face of the bolt and the cartridge case, for example because of accumulated dimensional tolerances, because of a difference in thermal expansion, or because moisture has been taken up by a cartridge made of a non-metallic material. The clearance between the front face of the bolt and the cartridge case can then be greater than the extent to which the tip of the striking pin projects from said front face, in which case the cartridge will not be fired.

This drawback cannot be avoided by increasing the extent to which the tip of the striking pin projects from the front face since during recoil of the cartridge on being fired, the cartridge case comes into contact with the front face of the bolt and its cap could be perforated by the striking pin.

Swiss patent No. 666 119 describes a striker device for a firearm, said device comprising means for compensating clearance between the bolt and the cartridge case, which means are constituted by a moving part that moves in the bolt and that has the striking pin passing axially therethrough. Said moving part is entrained by the pin and presses against the cartridge case so as to define a constant projection distance for the tip of the striking pin when firing the cartridge cap.

In that known device, it can happen that the moving part remains in its firing position where it projects from the front face of the bolt, thereby impeding or preventing relative movement, e.g. transverse movement, between the bolt and the firing chamber, and also running the risk of depeding or preventing a new cartridge being moved into the firing chamber.

A particular object of the invention is to provide a striker device which is not subject to the above drawbacks, while still enabling clearance between the front face of the bolt and the cartridge case to be taken up.

Another object of the invention is to provide a device of this type in which the extent to which the firing pin projects in the firing position is determined very accurately so as to avoid perforating the cap of the cartridge.

Another object of the invention is to provide a device of this type suitable for use with an electrically-fired gun.

SUMMARY OF THE INVENTION

To this end, the present invention provides a striker device for striking a firearm cartridge, the cartridge comprising a case provided with a cap and the firearm including a bolt having a front face that is normally intended to be pressed against the cartridge case, a striking pin guided to move in translation in the bolt and including a tip for striking the cap of the cartridge, means for displacing the striking pin between a cocked position in which the striking pin is retracted into the bolt and a firing position in which the tip of the striking pin projects from the front face of the bolt to strike the cap of the cartridge, means for taking up clearance between the front face of the bolt and the cartridge, said means comprising a part having the striking pin passing axially therethrough and itself displaceable in translation relative to the bolt to occupy a firing position in which its front end projects from the front face of the bolt and bears against the cartridge case, the extent to which the tip of the firing pin projects relative to the front end of the moving part in the firing position being defined in a manager that does not vary by the striking pin coming into abutment against the moving part, and abutment means being provided on the striking pin and on the moving part to displace the moving part into a retracted position inside the bolt when the striking pin is returned to its cocked position.

In this device, the abutments provided on the moving part and on the striking pin enable the moving part to be displaced forwards to take up automatically any clearance between the front face of the bolt and the cartridge case, they also limit forwards displacement of the striking pin relative to the moving part so that the extent to which the striking pin projects from the moving part remains fixed at a predetermined value with is selected to avoid running the risk of perforating the cap, and in addition they enable the moving part to be retracted automatically into the bolt when the striking pin is returned to its cocked position.

According to another feature of the invention, a compressions spring surrounding the striking pin is interposed between the rear end of the moving part and an abutment associated with the striking pin.

Such a spring serves to keep the moving part in its retracted position when the striking pin is in its cocked position so as to avoid impending insertion of a cartridge into the firing chamber and also so as to allow the moving part to move forwards to take up the above-mentioned clearance when the striking pin leaves its cocked position on its way towards its firing position.

According to another advantageous feature of the invention, the abutment associated with the striking pin is a ring that is axially movable relative to the striking pin and relative to the moving part. Forwards displacement of said ring relative to the moving part is limited by an abutment secured to the moving part.

In a preferred embodiment of the invention, the rear end of the moving part includes a cylinder in which the abovementioned moving ring and compression spring are received.

The device of the invention is equally usable in a conventional type of firearm in which the cap is fired by the shock of the striking pin striking it, and in an electrically fired gun in which the striking pin is made of an electrically conductive material and is electrically insulated from an "earth" constituted by the gun.

BRIEF DESCRIPTION OF THE DRAWINGS

An embodiment of the invention is described by way of example with reference to the accompanying drawings, in which.

DETAILED DESCRIPTION

Figure 1:
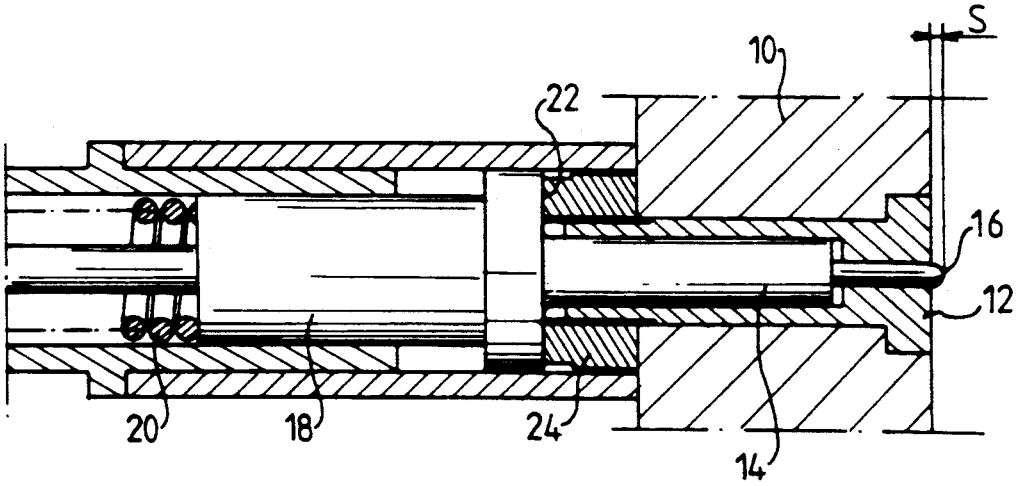
FIG. 1 is a fragmentary diagrammatic longitudinal section through a prior art striker device.

Reference is made initially to FIG. 1 which is a diagram showing a prior art striker device which is guided in translation in a bolt 10 that includes a bolt front face 12 which is normally pressed against the case of a cartridge (not shown) received in the firing chamber of a gun.

The striker device includes a striking pin 14 per se, whose leading end is shaped to a tip 16 for striking the cap of the cartridge, and whose rear end is secured to a striker mass 18 loaded by a spring 20. When the striking pin is in its firing position as shown in FIG. 1, its tip 16 projects by a relatively small distance S from the face 12 of the bolt, which distance is sufficient to fire the cap, while avoiding the risk of perforating it.

The distance S through which the tip projects is determined by construction and it is defined by a shoulder 22 of the striking pin bearing against a part 24 which is secured to the bolt 10.

It will be understood that if longitudinal clearance exists between the face 12 of the bolt and the cartridge case, and that if this clearance is greater than the distance S, then the cartridge will not be fired.

The invention seeks, in particular, to mitigate this drawback.

Figure 2:
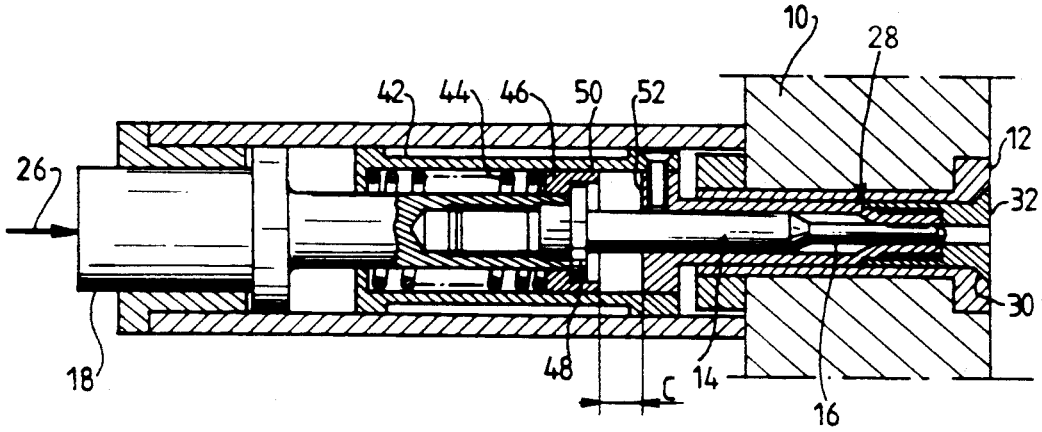
FIG. 2 is a diagrammatic longitudinal section view through a device of the invention shown in its cocked position.
Figure 3:
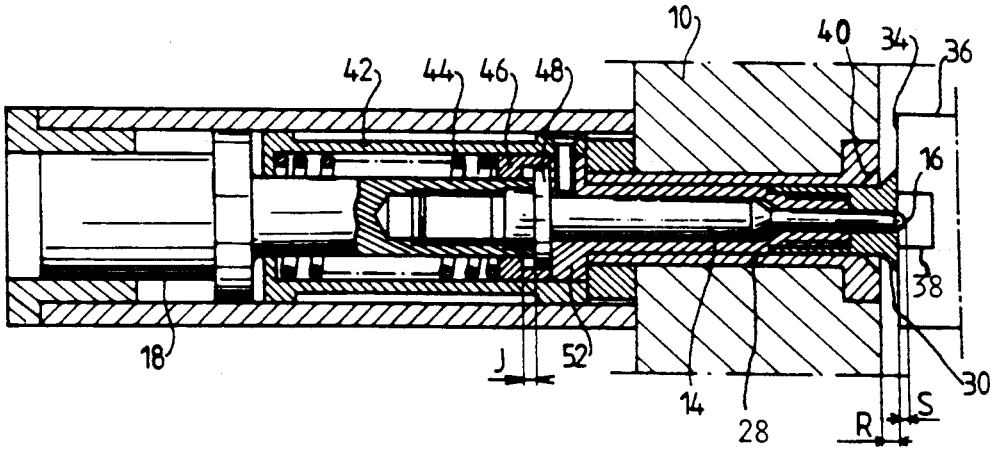
FIG. 3 is a view similar to FIG. 2, but showing the device in its firing position.

Reference is now made to FIGS. 2 and 3 which show an embodiment of the device of the invention, respectively in its cocked position and its firing position.

As in the prior art, this device includes a striking pin 14 whose leading end has a tip 16 and whose trailing end is secured to a striker mass 18 which is loaded in the direction indicated by arrow 26 by appropriate means such as a spring or a moving piston. The striking pin 14 is guided in translation through the bolt 10 which includes a front face 12 adjacent to the firing chamber.

According to the invention, the striking pin 14 is associated with a moving part 28 in which it is axially guided and which is itself guided in axial displacement through the bolt 10.

The front or "leading" end 30 of the moving part is flared in shape (e.g. frustoconical) and it has a flat front face 32 for pressing against the case 34 of a cartridge 36 provided with a firing cap 38. The front face 12 includes a tapering cavity 40 in which the flared leading end 30 of the moving part is received when it is in its retracted position.

The rear or "trailing" end of the moving part 28 is formed with a cylinder 42 having the striking pin 14 passing axially therethrough and in which a compression spring 44 is received whose rear end bears against the rear wall of the cylinder 42 and whose front end bears against a ring 46 that moves relative to the striking pin 14 inside the cylinder 42.

Inside the cylinder 42, the striking pin 14 includes an annular flange 48 against which the ring 46 bears under drive from the spring 44. The ring 46 also has a cylindrical skirt 50 which extends forwards and within which the annular flange 48 of the striking pin is received. The front end of the skirt 50 is designed to come into abutment against a wall 52 closing the front end of the cylinder 42, and is at a distance C from said wall 52 when the striking pin is in its cocked position as shown in FIG. 2.

This device operates as follows:

When the striking pin is in its cocked position as shown in FIG. 2, in which position it is held by any appropriate means, the front face 32 of the leading end of the moving part 28 is level with the front face 12 of the bolt and it does not project therefrom. The striking pin 14 is retracted with its tip 16 being received inside the part 28. The ring 46 bears against the annular flange 48 of the striking pin 14 and compresses the spring 44. In this position, the part 28 is thus urged rearwards by the thrust exerted by the spring 44 against the rear end wall of the cylinder 42.

In this position, there is no difficulty in bringing a cartridge 36 into the firing chamber, thereby bringing its cap 38 into alignment with the axis of the striking pin.

For the reasons mentioned above, there may be a relatively large amount of longitudinal clearance R (a few millimeters) between the front face 12 of the bolt and the cartridge case 34.

When the striking pin is released, it leaves its cocked position and it is thrust in the direction indicated by arrow 26. At the beginning of this movement, the moving part 28 remains in the position shown in FIG. 2 until the ring 46 under drive from the spring 44 has travelled through the distance C and bears against the front wall 52 of the cylinder 42. The annular flange 48 of the striking pin is caused to bear against said wall 52 and begins to displace the moving part 28 forwards starting from the position shown in FIG. 2. During this stage, the spring 44 does not oppose forwards displacement of the striking pin or of the part 28, thereby providing the advantage of using all of the kinetic energy of the moving assembly for percussion purposes.

The forwards displacement of the part 28 continues until its front face 32 engages the case 34 of the cartridge 36. The tip 16 of the striking pin which is projecting relative to said front face 32 simultaneously strikes the cap 38 and fires it.

The cartridge is thus fired after the clearance R between the front face 12 of the bolt and the case 34 of the cartridge has been taken up. In addition, the distance S through which the tip of the striking pin 16 projects relative to the front face 32 of the part 28 is accurately determined by the annular flange 48 of the striking pin coming into abutment against the front wall 52 of the cylinder 42, and this distance is selected to ensure that the cap is fired without any risk of it being perforated.

In the firing position shown in FIG. 3, there remains clearance J between the annular flange 48 of the striking pin 14 and the rear end of the ring 46.

While the gun is being reloaded, this clearance J allows the striking pin to be moved far enough rearwards relative to the part 28 and to the bolt 10 to ensure that the tip 16 of the striking pin is withdrawn from the cap and is received inside the part 28, thereby making relative movement, e.g. transverse movement, between the bolt and the firing chamber possible without running the risk of damaging the tip of the striking pin.

Thereafter, displacement of the striking pin towards its cocked position acts via the spring 44 to displace the moving part 28 rearwards until the device returns to the position shown in FIG. 2.

Finally, it should be observed that forwards displacement of the moving part 28 relative to the bolt 10 is limited to a maximum value corresponding to a maximum amount of clearance R that can be taken up, by the front wall 52 of the cylinder 42 coming into abutment against a part that is secured to the bolt.

We claim:

1. A striker device for striking a firearm cartridge, the cartridge comprising a case provided with a cap and the firearm including a bolt having a front face that is normally intended to be pressed against the cartridge case, a striking pin guided to move in translation in the bolt, means for displacing the striking pin between a cocked position and a firing position in which the striking pin projects from the front face of the bolt to strike the cap of the cartridge, means for taking up clearance between the bolt and the cartridge comprising a moving part having the striking pin passing axially therethrough and itself displaceable in translation relative to the bolt to occupy a front position in which the moving part projects from the bolt and bears against the cartridge case and the striking pin projects a first distance from the front end of the moving part, the distance which the firing pin projects relative to the moving part in the firing position being defined in a manner that does not vary by the striking pin contacting the moving part, a compression spring interposed between the moving part and a ring associated with the striking pin to urge the moving part resiliently towards a retracted position inside the bolt when the striking pin is returned to said cocked position, the moving part having a trailing end in form of a cylinder surrounding the striking pin and in which the compression spring and the said ring are received, the ring being axially movable with respect to the striking pin and the moving part and being urged by the compression spring towards the striking pin.

2. A device according to claim 1, in which said ring surrounds the striking pin and includes a front end for bearing against an abutment provided on the moving part.

3. A device according to claim 1, in which the moving part has an enlarged front end which is received in a correspondingly shape cavity in the front face of the bolt when the moving part is in said retracted position.

4. A device according to claim 3, in which the front end of the moving part and the cavity formed in the front face of the bolt are frustoconical in shape.

5. A device according to claim 1, in which the firearm is of the electrically fired type and the striking pin is made of an electrically conductive material.

* * * * *